US006431886B1

(12) United States Patent
Ramey et al.

(10) Patent No.: US 6,431,886 B1
(45) Date of Patent: Aug. 13, 2002

(54) POWER AND GUIDANCE CONNECTOR

(75) Inventors: Samuel C. Ramey; Kevin R. Meredith, both of Louisville, KY (US)

(73) Assignee: Robinson Nugent, Inc., New Albany, IN (US)

( * ) Notice: Subject to any disclaimer, the term of this patent is extended or adjusted under 35 U.S.C. 154(b) by 0 days.

(21) Appl. No.: 09/606,801

(22) Filed: Jun. 29, 2000

Related U.S. Application Data

(60) Provisional application No. 60/141,387, filed on Jun. 29, 1999.

(51) Int. Cl.[7] ..... H01R 4/66; H01R 13/648

(52) U.S. Cl. ..... 439/101; 439/378; 439/947

(58) Field of Search ..... 439/101, 65, 79, 439/80, 378, 947

(56) References Cited

U.S. PATENT DOCUMENTS 5,055,055 A * 10/1991 Bakker ..... 439/78
5,139,426 A 8/1992 Barkus et al.
5,158,471 A * 10/1992 Fedder et al. ..... 439/80
5,443,398 A * 8/1995 Ortega ..... 439/378
5,535,100 A * 7/1996 Lubahn et al. ..... 361/801
5,542,851 A 8/1996 Chikano
5,667,392 A * 9/1997 Kocher et al. ..... 439/79

FOREIGN PATENT DOCUMENTS

EP 0 560 551 A1 9/1993

* cited by examiner

*Primary Examiner*—Khiem Nguyen
*Assistant Examiner*—Brian S. Webb
(74) *Attorney, Agent, or Firm*—Barnes & Thornburg

(57) ABSTRACT

An electrical connector is provided having a first portion and a second portion for coupling a first printed circuit board to second printed circuit board. The first portion of the connector has board contacts for mechanically and electrically coupling to the first printed circuit board, electrical contacts coupled to the board contacts and a first alignment feature electrically and mechanically coupled to the first printed circuit board. The second portion of the connector has board contacts for mechanically and electrically coupling to the second printed circuit board, electrical contacts coupled to the board contacts and a second alignment feature electrically and mechanically coupled to the second printed circuit board. The first and second alignment portions cooperate to properly align the electrical contacts of the first and second board portions for electrical coupling upon mating of the connector portions. Upon mating the alignment features are electrically coupled.

11 Claims, 5 Drawing Sheets

POWER AND GUIDANCE CONNECTOR

This application claims priority from Provisional application Ser. No. 60/141,387, filed Jun. 29, 1999.

BACKGROUND AND SUMMARY OF THE INVENTION

This invention relates to electrical connectors and more specifically relates to electrical connectors providing power between a motherboard and daughtercard and providing for proper alignment of the daughtercard relative to the motherboard.

It is well known to fabricate electronic devices, especially computers, with a main printed circuit board called a motherboard, having sites for connection of secondary printed circuit boards ("daughtercards") thereto. These sites are often simply holes through the motherboard adjacent to traces connected to power lines and to communication lines. Motherboards typically contain circuitry printed thereon which is connected to a main power supply and provides communication between the main power supply and components on the motherboard as well as sites for connection of a daughtercard. Thus the motherboard is arranged to distribute power from the main power supply to properly connected components and daughtercards so that the components and daughtercards do not need their own dedicated power supply.

Proper distribution of the power from a motherboard to a daughtercard requires that the daughtercard be properly aligned when connected to the motherboard. One type of connecter commonly used for distributing power from a motherboard to a daughtercard is commonly referred to as a right angle power connecter. Right angle power connectors include a motherboard component having pins or the like for connection to the motherboard and a daughtercard component having pins or the like for connection to the daughtercard. The motherboard component and daughtercard component are designed to mate with each other so that when properly aligned signals present on the circuitry of the motherboard are communicated to appropriate circuitry on the daughtercard.

Daughtercards may be swapped to reconfigure the device containing the motherboard. It is often desirable to accomplish this reconfiguration without turning off the power to the device. Reconfiguration of a device by replacing one daughtercard with another without turning off the power is referred to as "hot swapping." Electronic device users who wish to reconfigure the device without powering down would appreciate an electrical connector which does not expose live contacts on the motherboard.

In accordance with the present invention, an electrical connector for coupling a motherboard having a power supply to a daughter card having power consuming components includes a board portion and a card portion configured to mate with the board portion. The board portion includes board contacts for coupling to the mother board, a guide pin, and electrical contacts electrically coupled to the board contacts. The card portion includes card contacts for coupling to the daughter card, a guide pin-receiving aperture, and electrical contacts electrically coupled to the card contacts and configured to couple to the electrical contacts of the board portion when the card portion is mated to the board portion.

An electrically connector in accordance with the present invention for coupling a first board having power consuming components to a second board having a power supply includes a first board component and a second board component configured to mate with the first board component. The first board component includes board contacts for coupling to the first board, a first alignment portion, and electrical contacts electrically coupled to the board contacts. The second board component includes board contacts for coupling to the second board, electrical contacts electrically coupled to the board contacts and configured to couple to the electrical contacts of the first board component when the first and second board components are properly aligned and mated, and a second alignment portion. The second alignment portion is configured to mate with the first alignment portion to properly align the first and second board components for mating.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

In describing the invention reference will be made to the following drawings in which.

DETAILED DESCRIPTION OF THE DRAWINGS

Figure 1:
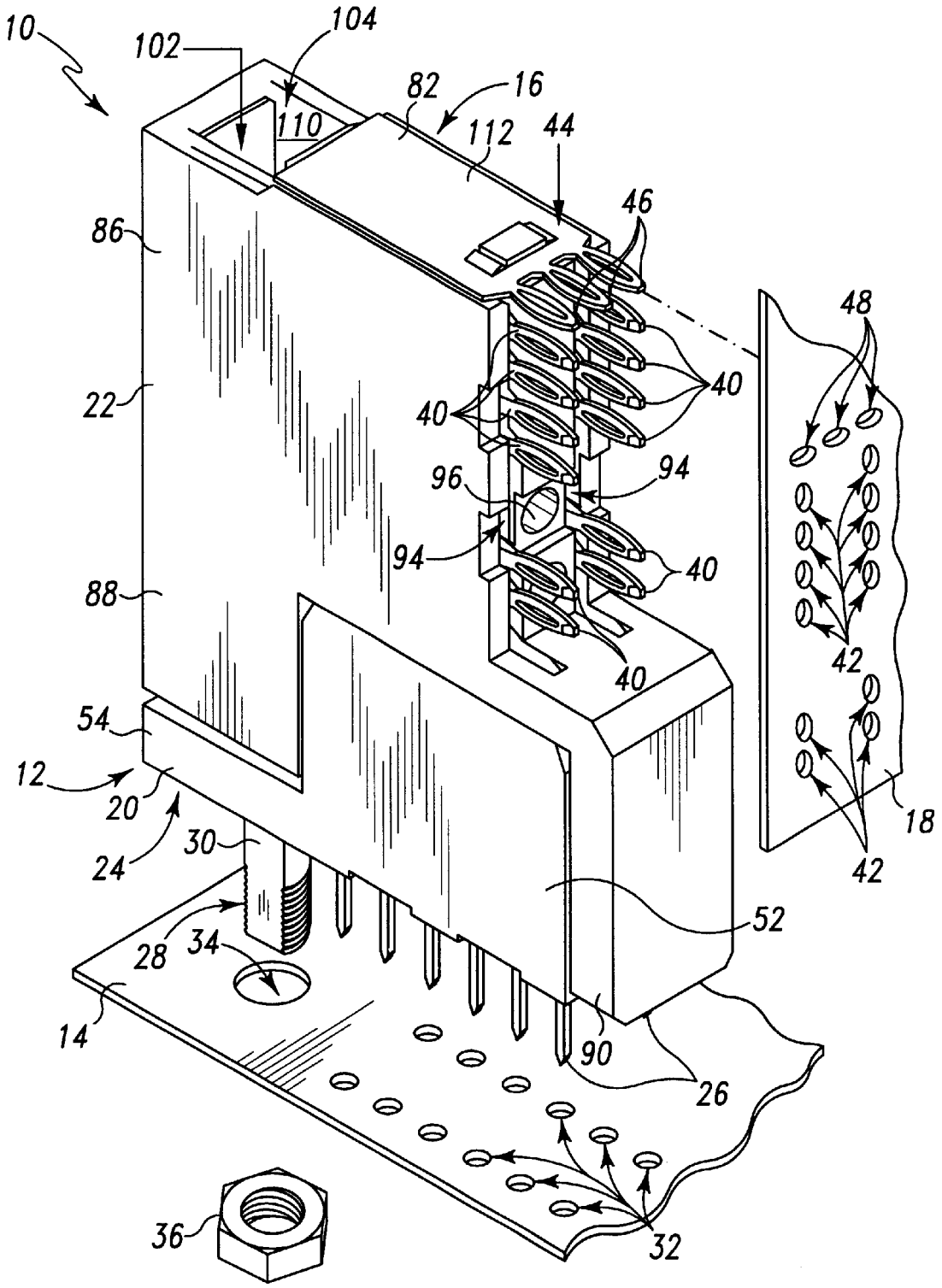
FIG. 1 a partially exploded perspective view of an inverse right angle connector including a motherboard component having a D-shaped threaded end of a guide pin and a plurality of connection pins extending from the board-engaging face of a housing for receipt in properly configured holes in a motherboard and a daughtercard component having a plurality of connection pins extending from a card-engaging face for receipt in properly configured holes in a daughtercard oriented substantially perpendicular to the motherboard, the motherboard component is shown mated to the daughtercard component to form the connector.

Referring to FIG. 1 there is shown a connector 10 having a motherboard component 12 for coupling to a motherboard 14 of an electronic device and a daughtercard component 16 for coupling to a daughtercard 18 of an electronic device. Motherboard component 12 includes a housing 20 and daughtercard component 16 includes a housing 22 with both housings 20,22 being configured to facilitate mating of motherboard component 12 to daughtercard component 16 as shown, for example, in FIG. 1. Illustrated connector 10 is of the type commonly referred to as a right angle connector because it facilitates connection of daughtercard 18 to motherboard 14 in a perpendicular fashion, as shown in FIG. 1.

Motherboard component 12 includes a board-engaging face 24 having connection pins 26 and a threaded end 28 of a guide pin 30 (having a D-shaped cross section at its end)(see FIGS. 2 and 4) extending perpendicularly therefrom. In the illustrated embodiment, twelve connection pins 26, arranged in two rows of six pins, each extend from board-engaging face 24 and are arranged for receipt in twelve through holes 32, arranged in two rows of six, and extending through motherboard 14. Connection of motherboard component 12 to motherboard 14 is illustratively accomplished by press fitting connection pins 26 in through holes 32 and passing threaded end 28 of guide pin 30 through aperture 34 formed in motherboard 14 and securing threaded end 28 to motherboard 14 with nut 36.

Figure 3:
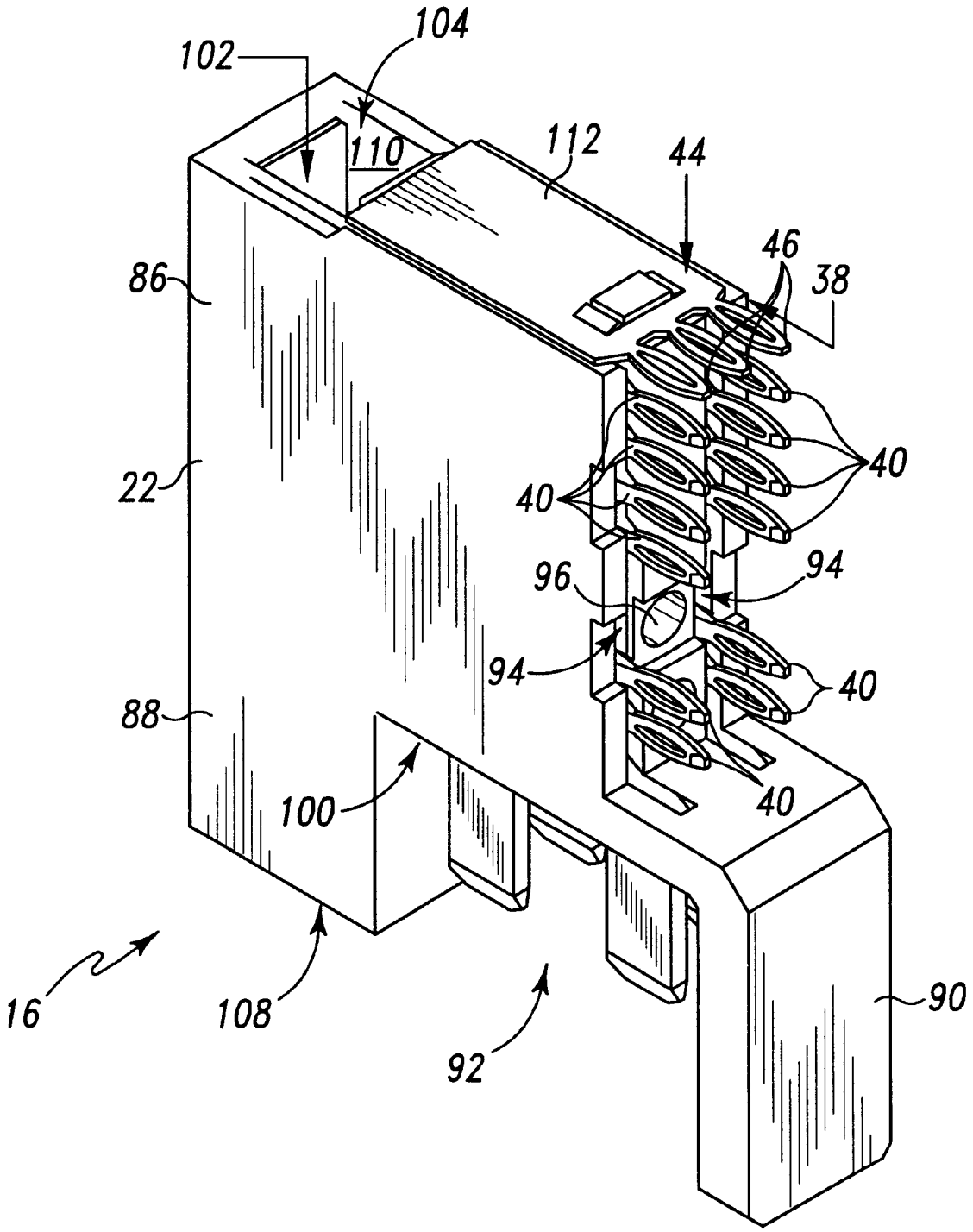
FIG. 3 is a perspective view of the daughtercard component of the inverse right angle connector of FIG. 1 showing four male power blades (two of which are partially obscured) extending from a downwardly facing surface of a recessed area of a housing for receipt in female receptacles in the motherboard component (shown in FIGS. 1, 2, and 4)
Figure 5:
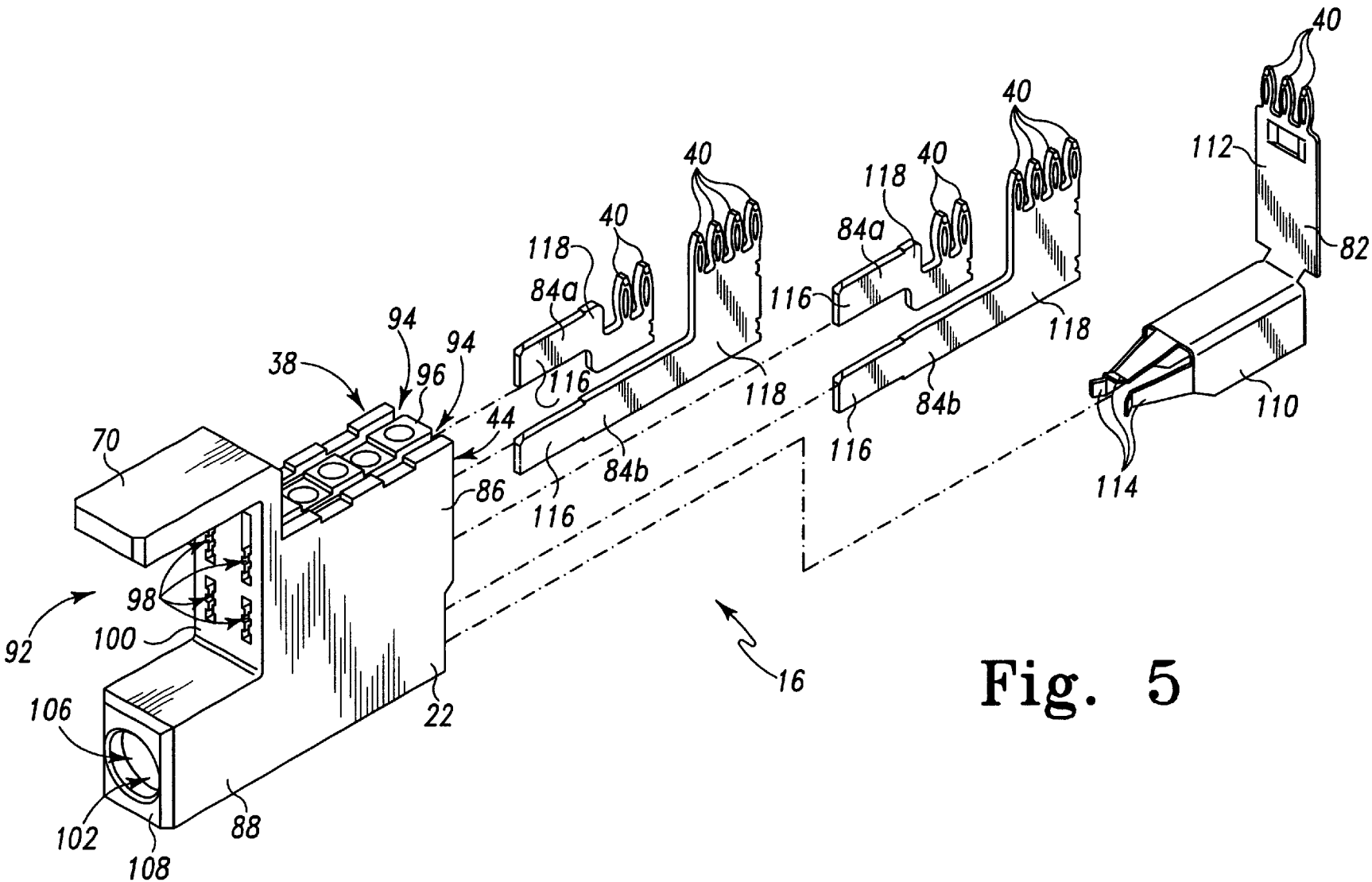

As shown, for example, in FIGS. 1, 3, and 5, daughtercard component 16 includes housing 22 having a card engaging face 38 through which twelve connection pins 40, arranged in two rows of six, extend perpendicularly to be received in twelve through holes 42, arranged in two rows of six, extending through daughtercard 18. Also extending perpendicularly from card-engaging face of housing 22 near top surface 44 are three connection pins 46 arranged in a row for receipt in three through holes 48 arranged in a row and extending through daughtercard 18. Illustratively connection pins 40 are designed to facilitate power transfer to power using components (not shown) of daughtercard 18 coupled through circuitry (not shown) terminating at through holes 42 on daughtercard 18. Connection pins 46 act to facilitate more secure coupling of daughtercard component 16 to daughtercard 18 and may serve other functions depending on the specific configuration of motherboard 14 and daughtercard 18 as will be described hereinafter.

Figure 2:
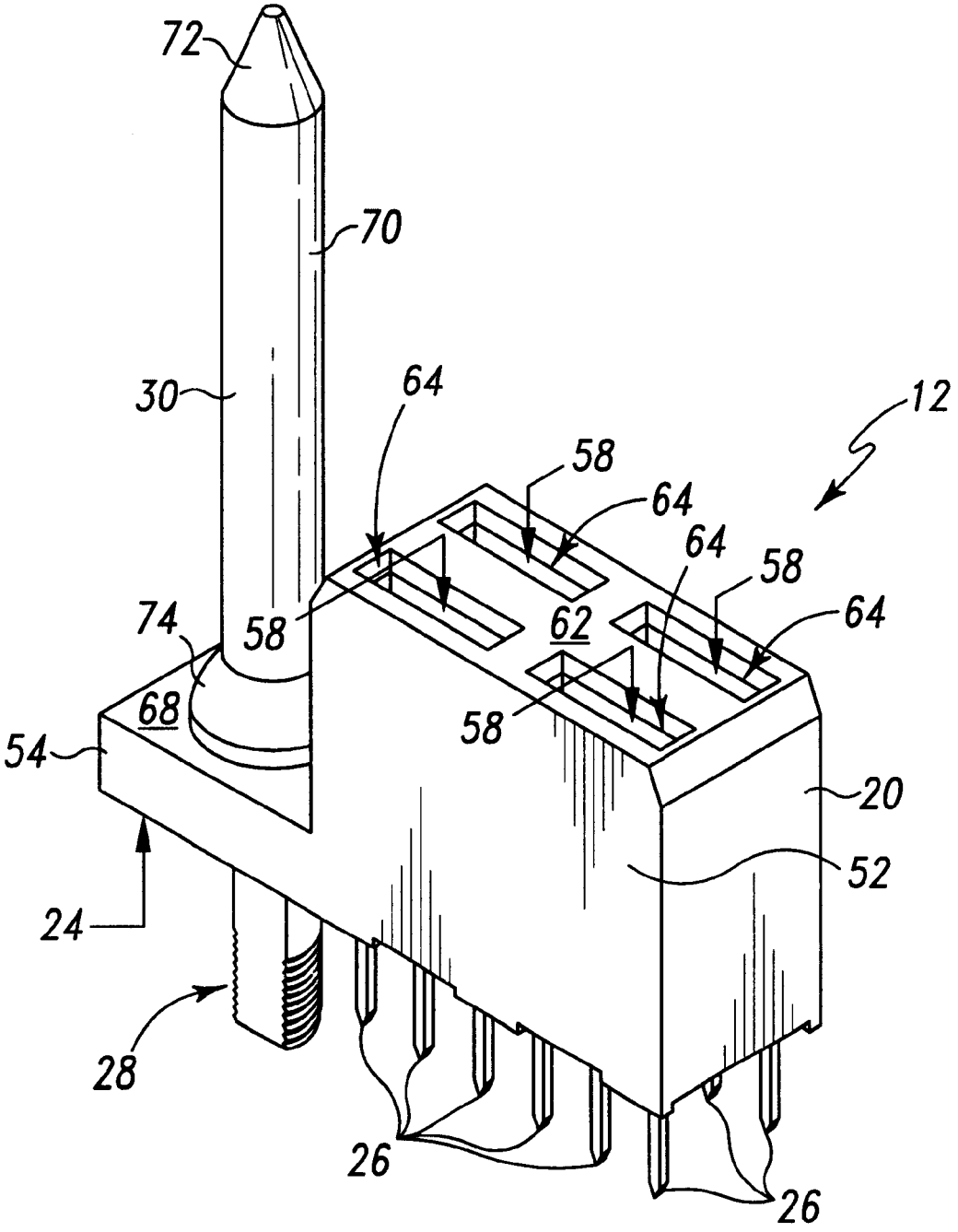
FIG. 2 is a perspective view of the motherboard component of the inverse right angle connector of FIG. 1 showing the D-shaped threaded end of guide pin extending through the housing to form a smooth round pin which, among other things, serves to guide the daughtercard component (shown in FIGS. 1, 3, and 5) into proper alignment to mate with the motherboard component, and four receptacle slots formed in the housing for receipt of power blades of the daughtercard component.
Figure 4:
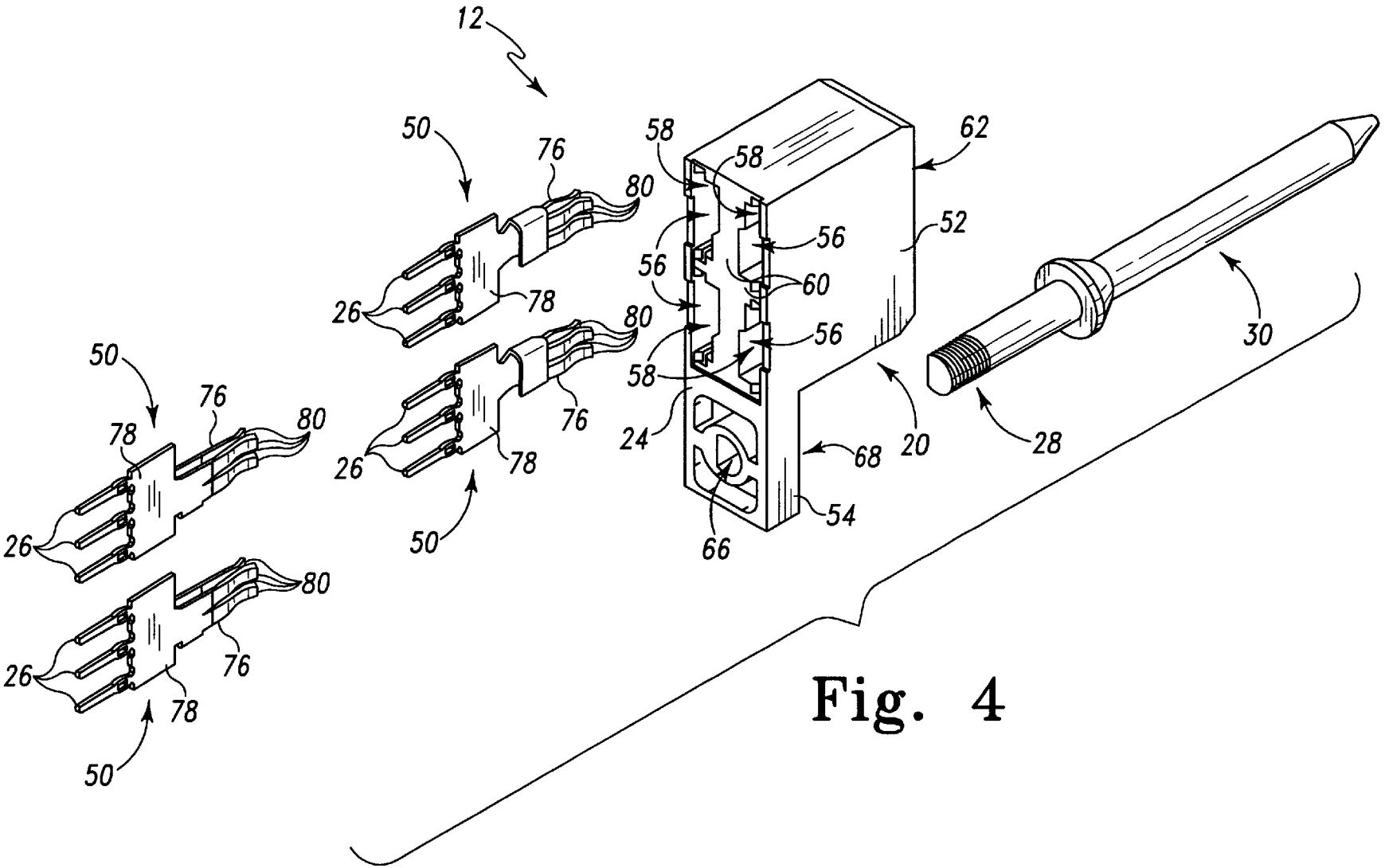
FIG. 4 is an exploded view of the motherboard component of FIG. 2 rotated about two axes to show four openings formed in the board-engaging face of the housing for receipt of four power contacts and a D-shaped aperture formed in the board-engaging face and extending through the housing for receipt of the guide pin, and also showing the four power contacts each having three press fit pins on one end coupled to female receptacles having cantilevered arms on the other end for receipt of a male blade and the guide pin having a first threaded end with a D-shaped cross section, a cylindrical shaft having a conical tip, and a frusto-conical stop at the junction of the cylindrical shaft and the threaded end; and, FIG. 5 is an exploded view of the daughtercard component of the connector of FIG. 3 rotated about two axes to reveal the downwardly facing surface of the recess of the housing showing four blades extending through the downwardly facing surface of the recess, a circular opening through the bottom surface of a boss communicating with the rectangular aperture in the housing, two pin slots formed in the card-engaging face of the housing each of which is in communication with two of the blade slots, four power blades each having a male blade at one end electrically coupled to a plurality of pins extending at right angles to the male blade at the other end, and a power or static discharge contact having three connection pins electrically connected to a receptacle formed to receive the guide pin.

Referring to FIGS. 2 and 4, motherboard component 12 of connector 10 is illustrated. Motherboard component 12 includes housing 20, guide pin 30, and four power contacts 50. Housing 20 of motherboard component 12 is formed of electrically insulating material and includes a box-shaped portion 52 and a flange 54 extending therefrom. Box-shaped portion 52 is formed to include four openings 56 extending through board-engaging surface 24 in communication with four power contact cavities 58 extending through the body of box-shaped portion 52. Power contact cavities 58 are separated and electrically insulated from each other by divider walls 60. Top surface 62 of box-shaped portion 52 is formed to include four power blade-receiving slots 64 each of which is in communication with a separate one of the four power contact cavities 58. Flange 54 is formed to include a D-shaped aperture 66 extending between board-engaging face 24 and top surface 68 of flange 54.

Guide pin 30 includes threaded end 28 with a D-shaped cross section, a cylindrical shaft 70 having a conical tip 72, and a frusto-conical stop 74 at the junction of the cylindrical shaft 70 and threaded end 28. Threaded end 28 of guide pin 30 is inserted through D-shaped aperture 66 in flange 54 until stop 74 engages top surface 68 of flange 54. Threaded end 28 extends substantially perpendicularly from board-engaging face 24 as shown, for example in FIG. 2. When threaded end 28 of guide pin 30 is coupled to motherboard 14 using nut 36 as previously described, guide pin 30 is electrically coupled to any contact immediately adjacent aperture 34 in motherboard 14. These contacts, if they exist, may be connected to power circuitry, ground circuitry, or static discharge circuitry. Thus depending on the configuration of motherboard 14, guide pin 30 may serve as a power contact, a ground contact, or a static discharge contact, as well as serve its main function of providing guidance to facilitate proper connection of motherboard component 12 to daughtercard component 16.

In the illustrated embodiment, each power contact 50 is identically configured as shown, for example, in FIG. 5. Each power contact 50 includes three connection pins 26, a blade receptacle 76, and an internal current path 78 coupling blade receptacle 76 to all three connection pins 26. Each power contact 50 is inserted into a separate one of power contact cavities 58. After insertion, blade receptacle 76 is positioned to lie adjacent to blade-receiving slot 64 and connection pins 26 extend substantially perpendicularly from board-engaging face 24. Blade receptacle 76 includes four cantilevered arms 80 arranged in opposing pairs to facilitate electrical coupling of a blade inserted through blade-receiving slot 64 and between opposing pairs of cantilevered arms 80 to connection pins 26. Each of the four power contacts 50 is electrically insulated from the others by dividing walls 60.

Referring to FIGS. 3 and 5, daughtercard component 16 of connector 10 is illustrated. Daughtercard component 16 includes housing 22, guide pin contact 82, and four power blades 84*a*, 84*b*. Housing 22 of daughtercard component 16 is formed of electrically insulating material and includes a body 86, a boss 88 extending from body 86, and a flange 90 extending from body 86. Body 86, boss 88, and flange 90 define a box-shaped recess 92 sized to receive box-shaped portion 52 of motherboard component 12 of connector 10, as shown for example, in FIG. 1. Body 86 includes a card-engaging surface 38 formed to include two slots 94 separated by dividing wall 96 formed therein. Slots 94 are in communication with blade-receiving cavities (obscured) extending from openings (obscured) in top surface 44 of daughtercard component 16, through body 86 to four blade slots 98 formed in downwardly facing surface 100 of recess 92. Body 86 is also formed to include a rectangular aperture 102 extending from rectangular opening 104 formed in top surface 44 through body 86 and boss 88 to circular opening 106 formed in bottom surface 108 of boss 88. Rectangular aperture 102 is separated from blade receiving cavities by an insulating wall (obscured).

Blade slots 98 in downwardly facing surface 100 are configured so that blades extending therethrough will also extend through blade-receiving slots 64 in top surface 62 of box-shaped portion 52 of motherboard component 12 when box-shaped portion 52 is received in recess 92 and motherboard component 12 is mated to daughtercard component 16. Circular opening 106 in bottom surface 108 is sized and arranged to receive guide pin 30 when motherboard component 12 is mated to daughtercard component 16. Frustoconical stop 74 engages walls of circular opening during mating to center cylindrical shaft 70 of guide pin 30 within rectangular aperture 102 of daughtercard component 16.

Guide pin contact 82 includes three contact pins 46, a guide pin receptacle 110, and an internal current path 112 coupling guide pin receptacle 110 to all three connection pins 46. Guide pin receptacle 110 includes three cantilevered arms 114, two of which are in form an opposing pair to facilitate electrical coupling of guide pin 30 to contact pins 46. Cantilevered arms 114 are arranged to be received in rectangular aperture 102 of body 86. When guide pin 30 is inserted through circular opening 106 and into rectangular aperture 102 during mating of motherboard component 12 to daughtercard component 16, conical tip 72 of guide pin 30 urges cantilevered arms 114 of guide pin receptacle 110 apart so that cantilevered arms 114 slide along cylindrical body 70 of guide pin 30 to provide electrical contact between guide pin 30 and guide pin contact 82. In the illustrated embodiment, internal current path 112 extends perpendicularly from guide pin receptacle 110 to connection pins 46. Internal current path 112 is rectangularly shaped and covers openings (obscured) in top surface 44 of body 86, as shown, for example in FIGS. 1 and 3. Depending on the configuration of motherboard 14, guide pin 30 may serve as a power contact, a ground contact, or a static discharge contact. Since guide pin contact 82 is electrically coupled to guide pin 30 when motherboard component 12 and daughtercard component 16 of connector 10 are mated, connection pins 46 may be coupled to appropriate ground, power, or static discharge circuitry on daughter card 18.

In the illustrated embodiment, two configurations of power blades 84*a*, 84*b* are illustrated, for example, in FIG. 5. Each power blade 84*a*, 84*b* includes a plurality of connection pins 26, a blade 116, and an internal current path 118 coupling blade 116 to all of the connection pins 26. Power blade 84*a* includes two connection pins 26 and power blade 84*b* includes four connection pins 26 in the illustrated embodiment. One of each configuration of power blades 84*a*, 84*b* is inserted into a separate one of power contact cavities so that blade 116 extends through blade slot 98 and connection pins 40 extend substantially perpendicularly from board-engaging face 38.

When motherboard component 12 is mated to daughtercard component 16, guide pin 30 is received in circular opening 106 in bottom surface 108 of daughtercard component 16 and frustoconical stop 74 engages walls of circular opening 106 to center cylindrical shaft 70 of guide pin 30 within rectangular aperture 102 of daughtercard component 16. Each blade 116 of daughtercard component 16 is received through blade-receiving slot 64 of motherboard component 12 and engages the blade receptacle 76 located adjacent thereto. Thus, connecting pins 40 of daughtercard component 16 are coupled to corresponding connecting pins 26 of motherboard component 12. A power source is electrically connected through circuitry on the motherboard 14 adjacent to through holes 32 to pins 26. Since pins 26 are coupled to pins 40 as previously described when motherboard component 12 is mated to daughtercard component 16, pins 40 are also coupled to power source. Circuitry on daughtercard 18 coupling through holes 42 and a power using component can then provide power to the power using component.

Connector 10 is configured as an inverse right angle connector providing guidance and power. Connector 10 is considered an inverse connector because the female receptacles 76 in the motherboard component 12 are coupled to the power supply. Thus the "hot" electrical contacts, i.e. the blade receptacles 76, are insulated against contact by a user during hot swapping. While the invention is described with reference to aright angle connector, it is to be understood that the scope of the invention should not be limited to that specific configuration of connector.

Although the invention has been described in detail with reference to a certain preferred embodiment, variations and modifications exist within the scope and spirit of the present invention as described and defined in the following claims.

What is claimed is:

1. An electrical connector for coupling a motherboard having a power supply to a daughter card having power consuming components, the electrical connector comprising:

a board portion having board contacts for coupling to the mother board, a guide pin adapted to be electrically and mechanically coupled to the motherboard, and electrical contacts electrically coupled to the board contacts;

a card portion configured to mate with the board portion, the card portion having card contacts for coupling to the daughter card, a guide pin-receiving aperture, and electrical contacts electrically coupled to the card contacts and configured to couple to the electrical contacts of the board portion when the card portion is mated to the board portion, and wherein the guide pin is received in the guide pin-receiving aperture during mating of the board portion and card portion and the guide pin and guide pin-receiving aperture cooperate to facilitate alignment of the electrical contacts in the board portion for mating with the electrical contacts in the card portion.

2. The electrical connector of claim 1 in which the board portion includes a housing and a plurality of board contacts coupled to electrical contacts attached to the housing in a configuration and the card portion includes a housing and a plurality of card contacts coupled to electrical contacts attached to the housing in a mating configuration.

3. The electrical connector of claim 2 in which the card portion includes guide pin contact adjacent the guide pin-receiving aperture positioned to engage the guide pin when the guide pin is received in the guide pin-receiving aperture.

4. The electrical connector of claim 2 wherein the electrical contacts of the card portion include blades and the electrical contacts of the board portion include receptacles positioned adjacent slots in the housing sized to receive the blades.

5. The electrical connector of claim 4 wherein the housing of the card portion includes a mating surface and the blades extend perpendicularly from the mating surface.

6. The electrical connector of claim 5 in which the card portion includes guide pin contact adjacent the guide pin-receiving aperture positioned to engage the guide pin when the guide pin is received in the guide pin-receiving aperture.

7. An electrical connector for coupling a first board having power consuming components to a second board having a power supply, the electrical connector comprising:

a first board component having board contacts for coupling to the first board, a first alignment portion, and electrical contacts electrically coupled to the board contacts;

a second board component configured to mate with the first board component, the second board component having board contacts for coupling to the second board, electrical contacts electrically coupled to the board contacts and configured to couple to the electrical contacts of the first board component when the first and second board components are properly aligned and mated, and a second alignment portion configured to mate with the first alignment portion to properly align the first and second board components for mating; and wherein at least one of the first and second alignment portions are configured to be mechanically and electrically coupled to the first or second board respectively and wherein further the first and second alignment portions cooperate to facilitate alignment of the electrical contacts in the first second board component for mating with the electrical contacts in the second board component during mating of the first and second board components.

8. The electrical connector of claim 7 wherein one of the electrical contacts of the first and second board components is a blade and the other of the electrical contacts of the first and second components is a receptacle sized to receive the blade.

9. The electrical connector of claim 8 wherein the first and second board components include a plurality of such electrical contacts.

10. The electrical connector of claim 9 wherein one of the first and second alignment portions is a guide pin and the other of the first and second alignment portions is a guide pin-receiving receptacle.

11. The electrical connector of claim 10 in which both the first and second alignment portions are adapted to be mechanically and electrically coupled to the first and second boards.

* * * * *